US009267400B2

(12) United States Patent
Yamanaka et al.

(10) Patent No.: US 9,267,400 B2
(45) Date of Patent: Feb. 23, 2016

(54) VARIABLE VALVE DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventors: Atsushi Yamanaka, Atsugi (JP); Ryo Tadokoro, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 14/410,405

(22) PCT Filed: Jul. 8, 2013

(86) PCT No.: PCT/JP2013/068632
§ 371 (c)(1),
(2) Date: Dec. 22, 2014

(87) PCT Pub. No.: WO2014/010550
PCT Pub. Date: Jan. 16, 2014

(65) Prior Publication Data

US 2015/0322826 A1 Nov. 12, 2015

(30) Foreign Application Priority Data

Jul. 12, 2012 (JP) ..... 2012-156598

(51) Int. Cl.
*F01L 1/34* (2006.01)
*F01L 1/352* (2006.01)

(52) U.S. Cl.
CPC ..... *F01L 1/352* (2013.01); *F01L 2101/00* (2013.01)

(58) Field of Classification Search
CPC ..... F01L 1/352; F01L 2101/00
USPC ..... 123/90.15, 90.17
See application file for complete search history.

(56) References Cited

U.S. PATENT DOCUMENTS

| | | | | |
|---|---|---|---|---|
| 8,544,432 | B2 | 10/2013 | Tadokoro et al. | |
| 2011/0253085 | A1* | 10/2011 | Kokubo | F01L 1/352 123/90.17 |
| 2011/0265747 | A1 | 11/2011 | Tadokoro et al. | |
| 2014/0014052 | A1 | 1/2014 | Tadokoro et al. | |

FOREIGN PATENT DOCUMENTS

| | | | |
|---|---|---|---|
| JP | 61-284519 | A | 12/1986 |
| JP | 2010-090889 | A | 4/2010 |
| JP | 2011-132808 | A | 7/2011 |
| JP | 2011-231700 | A | 11/2011 |

* cited by examiner

*Primary Examiner* — Zelalem Eshete
(74) *Attorney, Agent, or Firm* — Foley & Lardner LLP

(57) ABSTRACT

A device includes a timing sprocket configured to receive a rotational force from a crankshaft and includes an annular internal-teeth constituting portion having an inner circumferential portion formed with internal teeth; an eccentric shaft portion provided on a motor output shaft of an electric motor and formed in a cylindrical shape such that an outer circumferential surface of the eccentric shaft portion is eccentric relative to a rotational center of the eccentric shaft portion; and a plurality of rollers provided between the internal teeth and the eccentric shaft portion and having total number smaller than total number of the internal teeth. A laser hardening is performed from a tooth top and both tooth surfaces of each internal tooth to attain a high degree of hardness. On the other hand, a tooth bottom surface of each internal tooth is not treated with the laser hardening.

16 Claims, 6 Drawing Sheets

VARIABLE VALVE DEVICE FOR INTERNAL COMBUSTION ENGINE

TECHNICAL FIELD

The present invention relates to a variable valve device for an internal combustion engine, in which opening and closing characteristics of intake valve and/or exhaust valve (engine valves) of the internal combustion engine are controlled.

BACKGROUND ART

Recently, a variable valve device is proposed in which valve timings of intake or exhaust valve are controlled by transmitting rotative force of an electric motor through a speed-reduction mechanism to a cam shaft (output shaft) and thereby varying a relative rotational phase of the cam shaft to a sprocket to which rotative force is transmitted from a crankshaft.

For example, a variable valve device disclosed in Patent Literature 1 includes an eccentric shaft which receives rotative force of an electric motor, an internal-teeth constituting portion which is formed in a radially-inner portion of sprocket and formed with internal teeth, and a plurality of rollers which are provided between the internal teeth and the eccentric shaft and have total number smaller than total number of the internal teeth. This variable valve device employs a speed-reduction mechanism configured to output rotative force from a retainer that restricts a circumferential movement of the plurality of rollers.

CITATION LIST

Patent Literature

Patent Literature 1: Japanese Patent Application Publication No. 2011-231700

SUMMARY OF THE INVENTION

Problem to be Solved

However, in the case of variable valve device disclosed in Patent Literature 1, alternating torque generated in the cam shaft due to spring force of a valve spring is transmitted to the retainer of the speed-reduction mechanism. This alternating torque generates a relatively large load which tries to cause the plurality of rollers held by the retainer to move circumferentially and ride over the internal teeth.

Accordingly, there is a problem that a tooth top and both tooth surfaces (both tooth-side surfaces) of each internal tooth of the internal-teeth constituting portion are abraded or worn so that a play (clearance) between the rollers and the teeth is produced resulting in generation of noises.

Hence, it is conceivable that the tooth top and the both tooth surfaces of each internal tooth are made to have a high degree of hardness to reduce the abrasion. However, if the hardness of these portions is excessively high, there is a risk that the rollers are abraded contrarily.

It is an object of the present invention to provide a variable valve device for an internal combustion engine, devised to suppress the occurrence of abrasion between the rollers and the internal teeth of the internal-teeth constituting portion even if alternating torque is applied to the retainer.

Solution to Problem

A device recited in claim 1 according to the present invention comprises: a drive rotating member configured to receive a rotational force from a crankshaft, the drive rotating member including an annular internal-teeth constituting portion having an inner circumferential portion formed with internal teeth; an electric motor including a motor output shaft configured to rotate relative to the drive rotating member on request; an eccentric shaft portion provided on the motor output shaft and formed in a cylindrical shape such that an outer circumferential surface of the eccentric shaft portion is eccentric relative to a rotational center of the eccentric shaft portion; a plurality of rollers provided between the internal teeth and the eccentric shaft portion and having total number smaller than total number of the internal teeth; and a driven rotating member configured to rotate integrally with a cam shaft, permit the rollers to move in a radial direction of the driven rotating member according to the eccentric shaft portion, and restrict a movement of the rollers in a circumferential direction of the driven rotating member, wherein a hardness of a tooth bottom surface of the internal teeth of the internal-teeth constituting portion is lower than a hardness of a tooth top and a tooth surface of the internal teeth.

Effects of Invention

Accordingly, the occurrence of abrasion between the rollers and the internal teeth of the internal-teeth constituting portion can be sufficiently suppressed even if alternating torque is applied to the retainer.

DETAILED DESCRIPTION OF INVENTION

Figure 1:
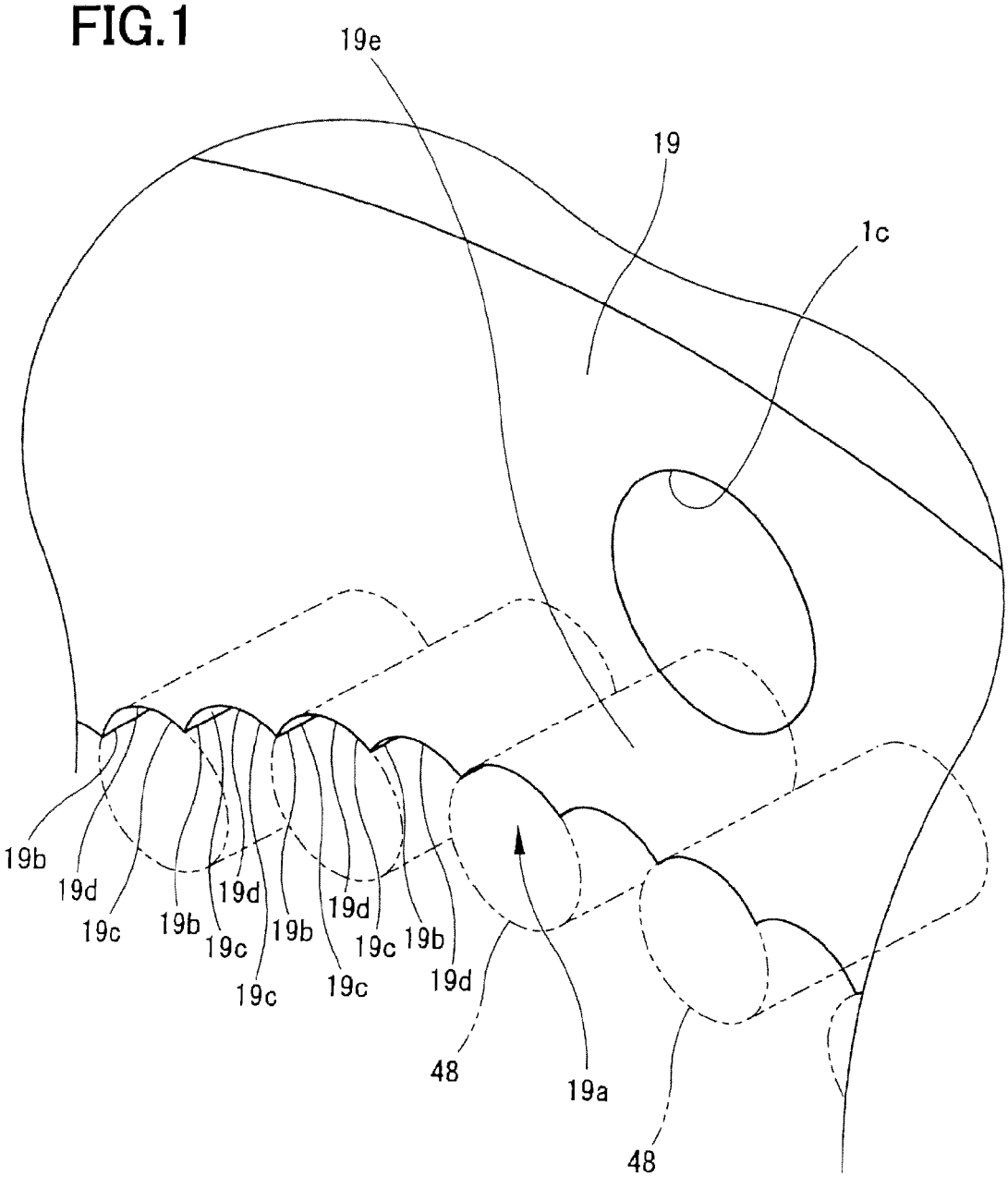
FIG. 1 An enlarged sectional view illustrating rollers and internal teeth of an internal-teeth constituting portion provided in a variable valve device in an embodiment according to the present invention.

Hereinafter, embodiments of variable valve device for an internal combustion engine according to the present invention will be explained referring to the drawings. In the following embodiments, the variable valve device according to the present invention is applied to an intake side of the internal combustion engine. However, the variable valve device according to the present invention is also applicable to an exhaust side of the internal combustion engine.

Figure 2:
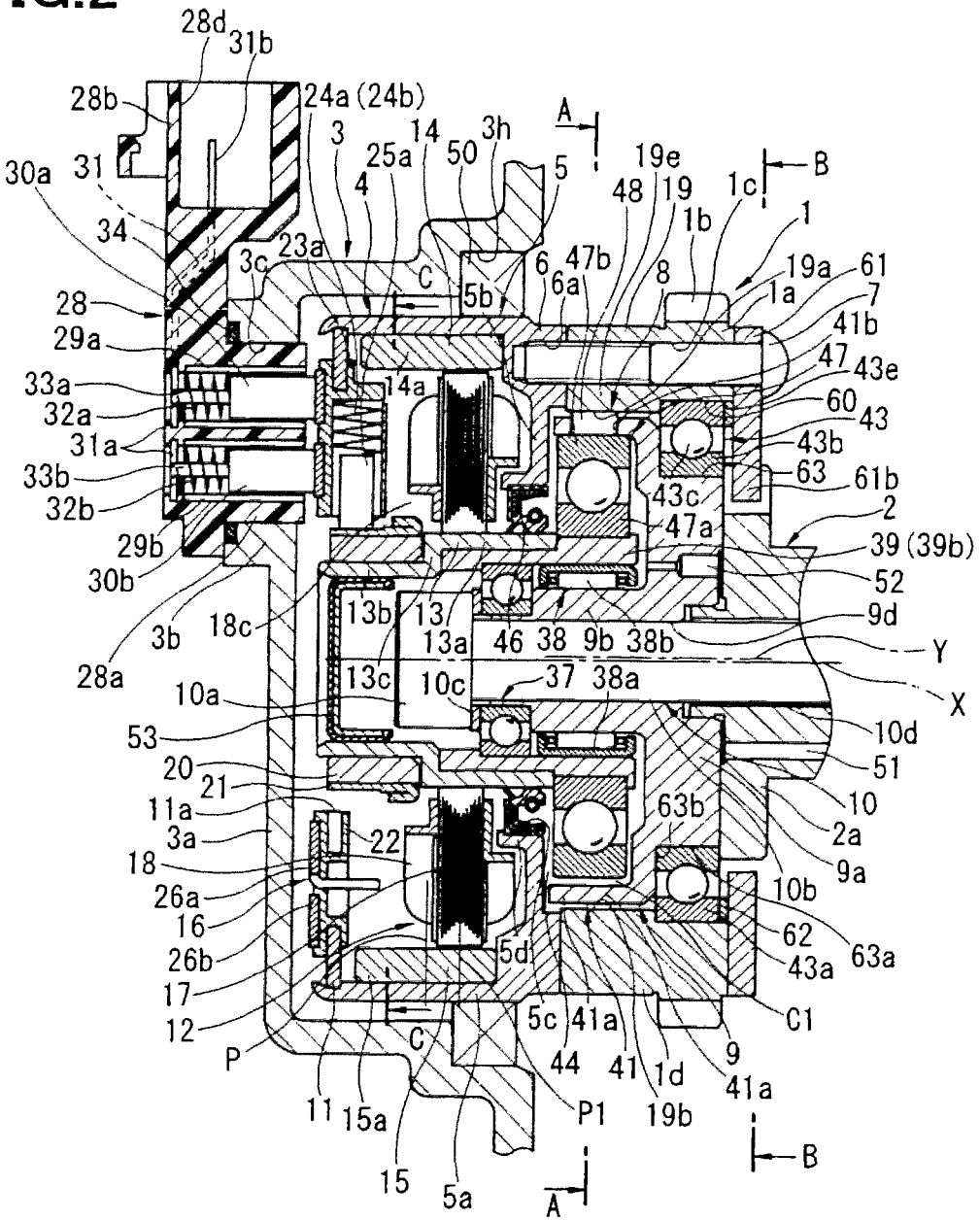
FIG. 2 A longitudinal sectional view illustrating the variable valve device in the embodiment according to the present invention.
Figure 3:
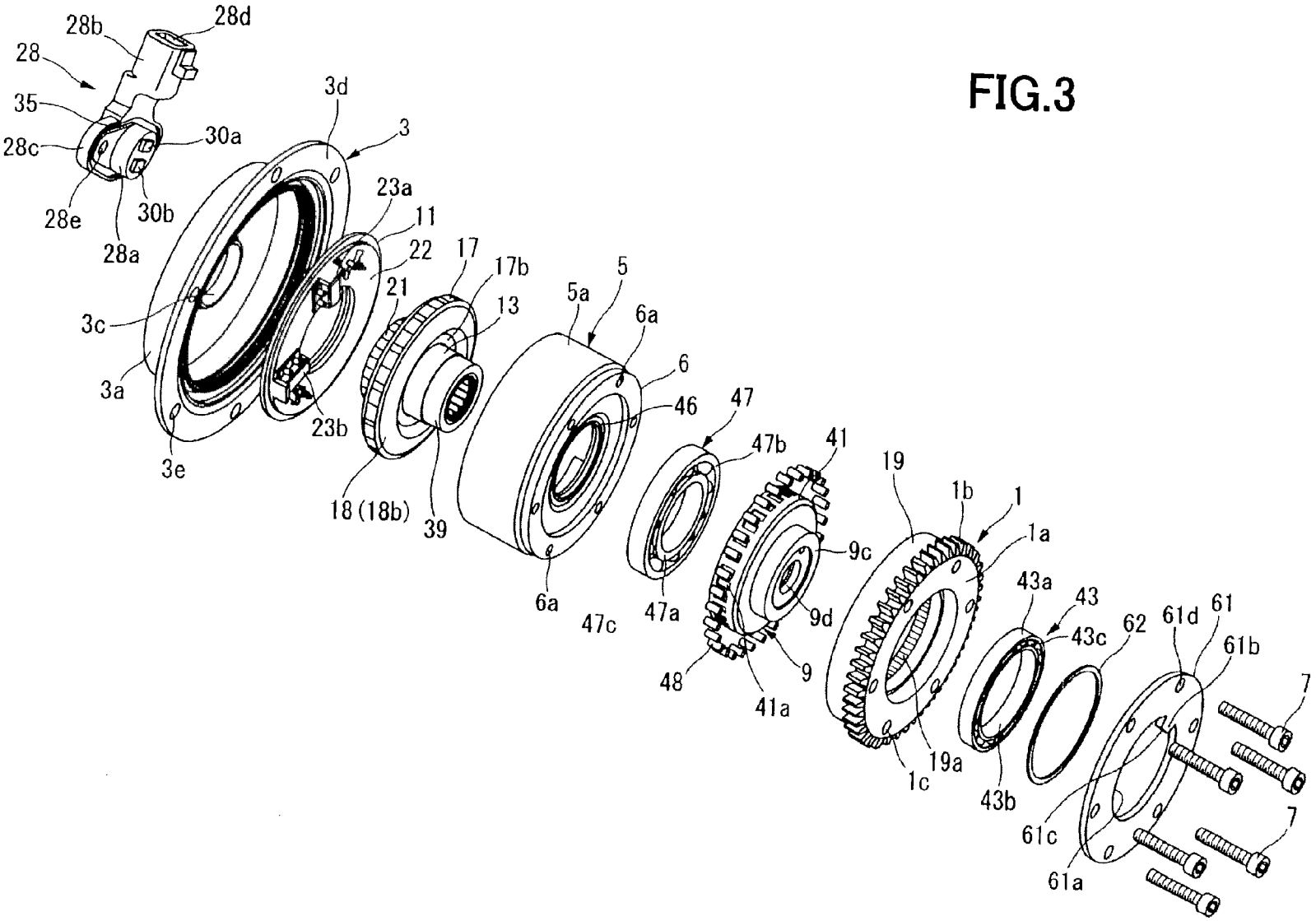
FIG. 3 An exploded oblique perspective view illustrating main structural elements in the embodiment.

As shown in FIGS. 2 and 3, the variable valve device includes a timing sprocket 1, a cam shaft 2, a cover member 3 and a phase change mechanism 4. The timing sprocket 1 (functioning as a drive rotating member) is rotated and driven by a crankshaft of the internal combustion engine. The cam shaft 2 is rotatably supported on a cylinder head through a bearing (not shown), and is rotated by a rotational force transmitted from the timing sprocket 1. The cover member 3 is provided on a front side (in an axially frontward direction) of the timing sprocket 1, and is fixedly attached to a chain cover (not shown). The phase change mechanism 4 is provided between the timing sprocket 1 and the cam shaft 2, and is configured to change a relative rotational phase between the timing sprocket 1 and the cam shaft 2 in accordance with an operating state of the engine.

Whole of the timing sprocket 1 is integrally formed of an iron-based metal in an annular shape. The timing sprocket 1 includes a sprocket main body 1*a*, a gear portion 1*b* and an internal-teeth constituting portion (internal-gear portion) 19. An inner circumferential surface of the sprocket main body 1*a* is formed in a stepped shape to have two relatively large and small diameters. The gear portion 1*b* is formed integrally with an outer circumference of the sprocket main body 1*a*, and receives rotational force through a wound timing chain (not shown) from the crankshaft. The internal-teeth constituting portion 19 is formed integrally with a front end portion of the sprocket main body 1*a*.

A surface treatment is applied to an outer surface of the gear portion 1*b* by means of laser hardening (laser heat treatment). An effective hardening depth (effective case depth) of this surface treatment is approximately in a range from 0.3 mm to 1.5 mm.

Figure 7:
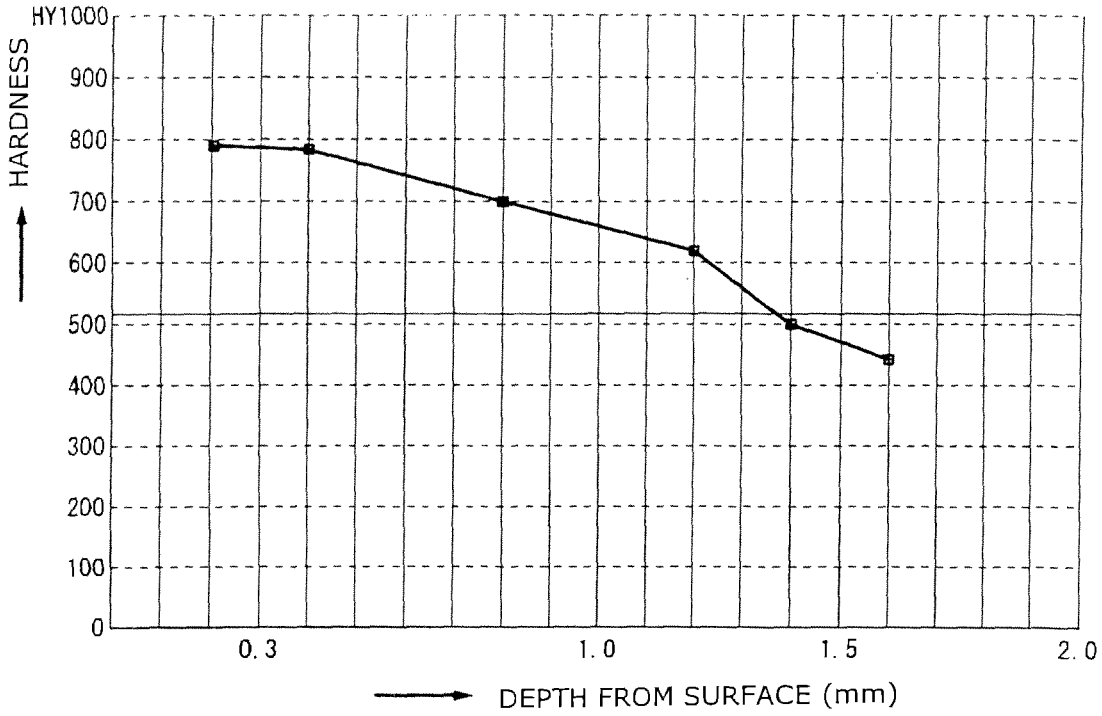
FIG. 7 A graph illustrating the relation between a hardness and a surface depth of laser hardening applied to a gear portion and the internal teeth in the embodiment.

The effective hardening depth is set within the range from 0.3 mm to 1.5 mm, for purpose of causing a hardness (Vickers hardness) of tooth top 19*b* and both tooth surfaces (flanks) 19*c* of each of internal teeth 19*a* of the internal-teeth constituting portion 19 to approximately fall within a range between 800 HV and 500 HV as shown by a graph of FIG. 7.

A large-diameter ball bearing 43 which is a bearing having a relatively large diameter is interposed between the sprocket main body 1*a* and an after-mentioned follower member 9 provided on a front end portion of the cam shaft 2. The timing sprocket 1 is rotatably supported by the cam shaft 2 through the large-diameter ball bearing 43 such that a relative rotation between the cam shaft 2 and the timing sprocket 1 is possible.

The large-diameter ball bearing 43 includes an outer race 43*a*, an inner race 43*b*, and a ball(s) 43*c* interposed between the outer race 43*a* and the inner race 43*b*. The outer race 43*a* of the large-diameter ball bearing 43 is fixed to an inner circumferential portion (i.e., inner circumferential surface) of the sprocket main body 1*a* whereas the inner race 43*b* of the large-diameter ball bearing 43 is fixed to an outer circumferential portion (i.e., outer circumferential surface) of the follower member 9.

The inner circumferential portion of the sprocket main body 1*a* is formed with an outer-race fixing portion 60 which is in an annular-groove shape as obtained by cutting out a part of the inner circumferential portion of the sprocket main body 1*a*. The outer-race fixing portion 60 is formed to be open toward the cam shaft 2.

The outer-race fixing portion 60 is formed in a stepped shape to have two relatively large and small diameters. The outer race 43*a* of the large-diameter ball bearing 43 is fitted into the outer-race fixing portion 60 by press fitting in an axial direction of the timing sprocket 1. Thereby, one axial end of the outer race 43*a* is placed at a predetermined position, that is, a positioning of the outer race 43*a* is performed.

The internal-teeth constituting portion 19 is formed integrally with an outer circumferential side of the front end portion of the sprocket main body 1*a*. The internal-teeth constituting portion 19 is formed in a cylindrical shape (circular-tube shape) extending in a direction toward an electric motor 12 of the phase change mechanism 4. An inner circumference of the internal-teeth constituting portion 19 is formed with wave-shaped internal teeth (internal gear) 19*a*.

Figure 4:
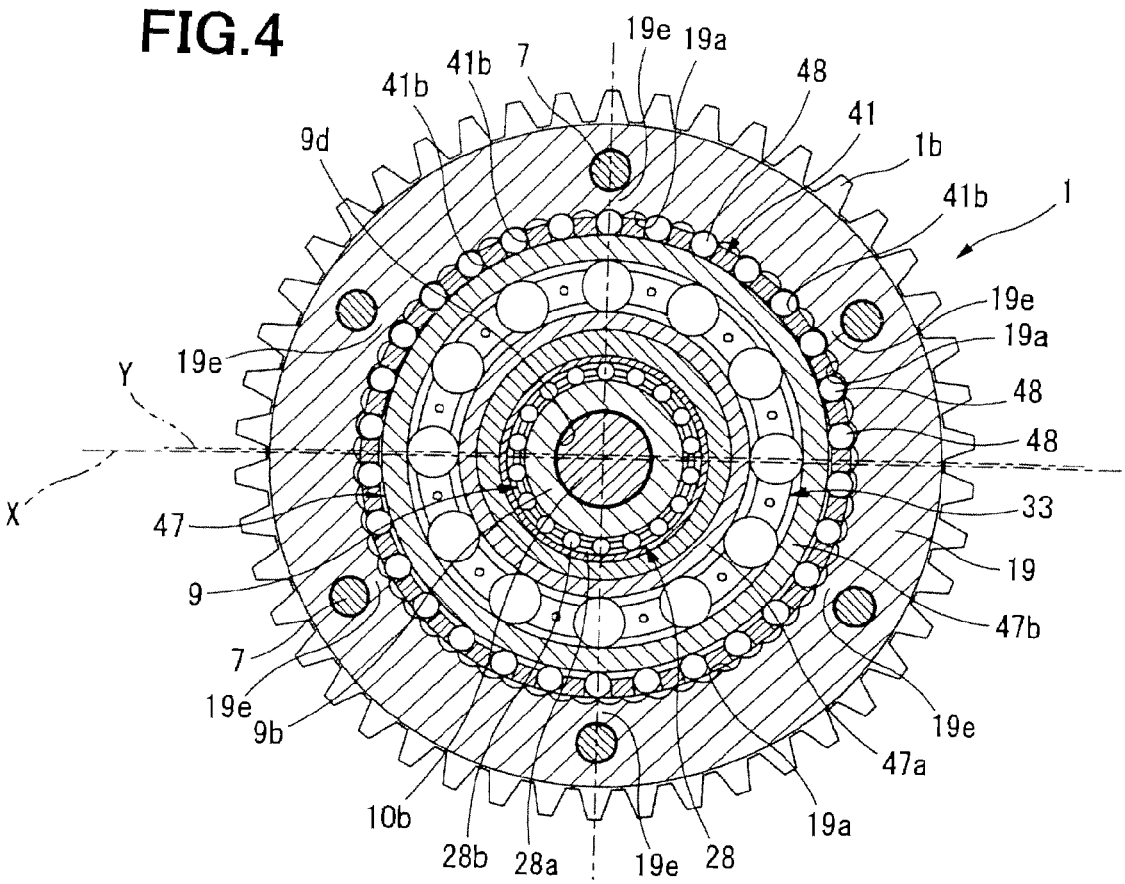
FIG. 4 A sectional view of FIG. 2, taken along a line A-A.

As shown in FIGS. 1 and 4, the internal teeth 19*a* are formed continuously along a circumferential direction of the internal-teeth constituting portion 19 such that each internal tooth 19*a* is equally spaced from adjacent internal tooth 19*a*. Each internal tooth 19*a* includes a tooth top 19*b*, both tooth surfaces (flanks) 19*c* and 19*c*, and a tooth bottom surface 19*d*. The tooth top 19*b* is formed in a V-shape (angle shape). The both tooth surfaces 19*c* and 19*c* are continuous with the tooth top 19*b* and extend in both circumferential directions of the internal-teeth constituting portion 19. The tooth bottom surface 19*d* is located between the tooth surfaces 19*c* and 19*c*.

In the same manner as the gear portion 1*b*, the tooth top 19*b* and the both tooth surfaces 19*c* and 19*c* of each internal tooth 19*a* of the internal-teeth constituting portion 19 are treated with the laser hardening, so that the tooth top 19*b* and the tooth surface 19*c* have a hardness higher than that of a portion including the tooth bottom surface 19*d*.

That is, the laser-hardening surface treatment is applied to the tooth top 19*b* and the both tooth surfaces 19*c* and 19*c* of each internal tooth 19*a* such that the effective hardening depth (effective case depth) substantially falls within the range from 0.3 mm to 1.5 mm. This laser-hardening surface treatment is not applied to the tooth bottom surfaces 19*d* and an outer circumferential portion of the internal-teeth constituting portion 19 which includes after-mentioned thin-wall portions 19*e*, except the tooth tops 19*b* and the both tooth surfaces 19*c* and 19*c*. Therefore, a hardness (Vickers hardness) of the tooth tops 19*b* and the both tooth surfaces 19*c* and 19*c* is approximately in the range between 800 HV and 490 HV whereas the tooth bottom surfaces 19*d* and the outer circumferential portion of the internal-teeth constituting portion 19 have a hardness of normal iron-base metal, i.e. are relatively flexible. As mentioned above, in the laser-hardening surface treatment which is applied to the tooth tops 19*b* and the both tooth surfaces 19*c* and 19*c*, the effective hardening depth is set to be approximately within the range between 0.3 mm and 1.5 mm in the same manner as the gear portion 1*b*. This setting is done for purpose of causing the hardness of the tooth tops 19*b* and the both tooth surfaces 19*c* of each internal tooth 19*a* to approximately fall within the range between 800 HV and 500 HV as shown by the graph of FIG. 7.

Moreover, a female-thread constituting portion 6 formed integrally with an after-mentioned housing 5 for the electric motor 12 is placed to face a front end portion of the internal-teeth constituting portion 19. The female-thread constituting portion 6 is formed in an annular shape.

Moreover, an annular retaining plate 61 is disposed on a (axially) rear end portion of the sprocket main body 1*a*, on the side opposite to the internal-teeth constituting portion 19. This retaining plate 61 is integrally formed of metallic sheet material. As shown in FIG. 2, an outer diameter of the retaining plate 61 is approximately equal to an outer diameter of the sprocket main body 1*a*. An inner diameter of the retaining plate 61 is approximately equal to a diameter of a radially center portion of the large-diameter ball bearing 43.

Therefore, an inner circumferential portion 61*a* of the retaining plate 61 faces and covers an axially outer end surface 43*e* of the outer race 43*a* through a predetermined clearance. Moreover, a stopper convex portion 61*b* which protrudes in a radially-inner direction of the annular retaining plate 61, i.e. protrudes toward a central axis of the annular retaining plate 61 is provided at a predetermined location of an inner circumferential edge (i.e., radially-inner edge) of the inner circumferential portion 61*a*. This stopper convex portion 61*b* is formed integrally with the inner circumferential portion 61*a*.

Figure 5:
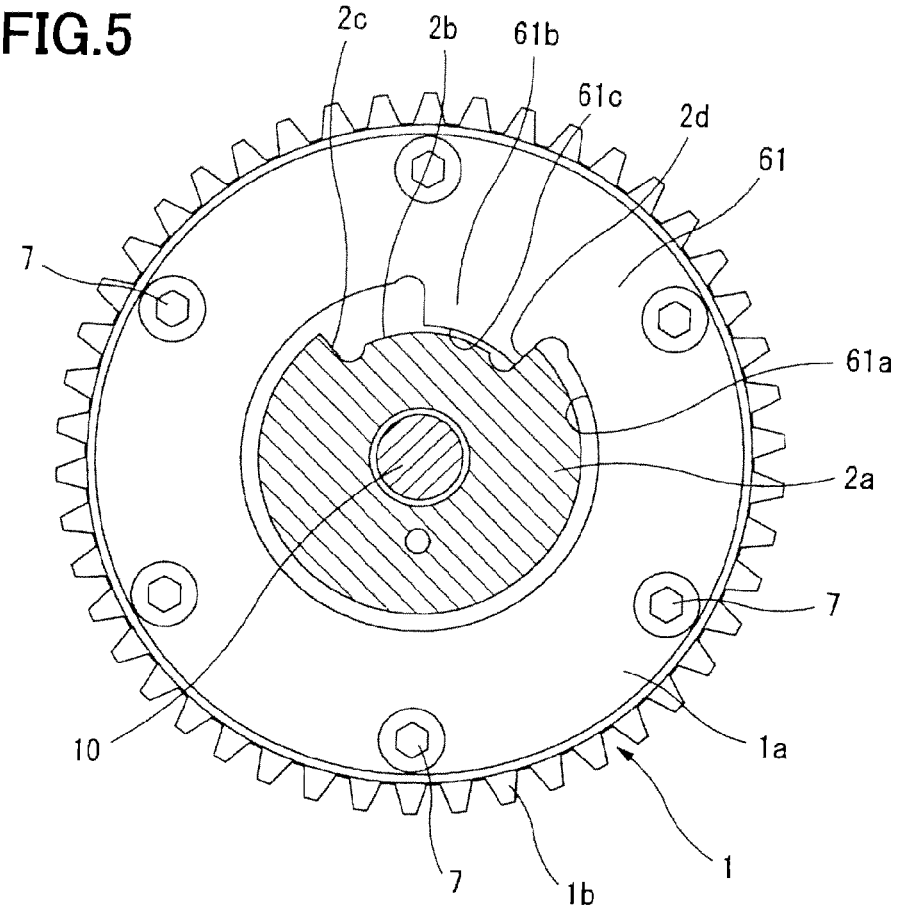
FIG. 5 A sectional view of FIG. 2, taken along a line B-B.

As shown in FIGS. 3 and 5, the stopper convex portion 61*b* is formed in a substantially fan shape. A tip edge 61*c* of the stopper convex portion 61*b* is formed in a circular-arc shape in cross section, along a circular-arc-shaped inner circumferential surface of an after-mentioned stopper groove 2*b*. Moreover, an outer circumferential portion of the retaining plate 61 is formed with six bolt insertion holes 61*d* each of which passes through the retaining plate 61. The six bolt insertion holes 61*d* are formed at circumferentially equally-spaced intervals in the outer circumferential portion of the retaining plate 61. A bolt 7 is inserted through each of the six bolt insertion holes 61*d*.

An annular spacer 62 is interposed between an axially inner surface of the retaining plate 61 and the outer end surface 43*e* of the outer race 43*a* of the large-diameter ball bearing 43. Thereby, the inner surface of the retaining plate 61 faces the outer end surface 43*e* through the annular spacer 62. By this spacer 62, the inner surface of the retaining plate 61 applies a slight pressing force to the outer end surface 43*e* of the outer race 43*a* when the retaining plate 61 is jointly fastened to the timing sprocket 1 and the housing 5 by the bolts 7. However, a thickness of the spacer 62 is set at a certain degree at which a minute clearance between the outer end surface 43*e* of the outer race 43*a* and the retaining plate 61 is produced within a permissible range for an axial movement of the outer race 43*a*.

An outer circumferential portion of the sprocket main body 1*a* (the internal-teeth constituting portion 19) is formed with six bolt insertion holes 1*c* each of which axially passes through the timing sprocket 1*a*. The six bolt insertion holes 1*c* are formed substantially at circumferentially equally-spaced intervals in the outer circumferential portion of the sprocket main body 1*a*. Moreover, the female-thread constituting portion 6 is formed with six female threaded holes 6*a* at its portions respectively corresponding to the six bolt insertion holes 1*c* and the six bolt insertion holes 61*d* of the outer circumferential portion of the retaining plate 61. By the six bolts 7 inserted into the six bolt insertion holes 61*d*, the six bolt insertion holes 1*c* and the six female threaded holes 6*a*; the timing sprocket 1*a*, the retaining plate 61 and the housing 5 are jointly fastened to one another from the axial direction.

It is noted that the sprocket main body 1*a* and the internal-teeth constituting portion 19 function as a casing for an after-mentioned speed-reduction mechanism 8.

The timing sprocket 1*a*, the internal-teeth constituting portion 19, the retaining plate 61 and the female-thread constituting portion 6 have outer diameters substantially equal to one another.

The cover member 3 is made of aluminum alloy material and is integrally formed in a cup shape. The cover member 3 includes a bulging portion (expanded portion) 3*a* formed at a front end portion of the cover member 3. The bulging portion 3*a* covers a front end portion of the housing 5. An outer circumferential portion of the bulging portion 3*a* is formed with a cylindrical wall 3*b* extending in the axial direction. As shown in FIGS. 2 and 3, the cylindrical wall 3*b* is formed integrally with the bulging portion 3*a* and includes a retaining hole 3*c* therein. An inner circumferential surface of the retaining hole 3*c* functions as a guide surface for an after-mentioned brush retaining member 28.

As shown in FIG. 2, the cover member 3 includes a flange portion 3*d* formed at an outer circumference of the cover member 3. The flange portion 3*d* is formed with six bolt insertion holes 3*e*. Each of the six bolt insertion holes 3*e* passes through the flange portion 3*d*. By bolts (not shown) inserted through the bolt insertion holes 3*e*, the cover member 3 is fixed to the chain cover.

As shown in FIG. 2, an oil seal 50 which is a seal member having a large diameter is interposed between an outer circumferential surface of the housing 5 and an inner circumferential surface of a stepped portion (multilevel portion) of outer circumferential side of the bulging portion 3*a*. The large-diameter oil seal 50 is formed in a substantially U-shape in cross section, and a core metal is buried inside a base material formed of synthetic rubber. An annular base portion of outer circumferential side of the large-diameter oil seal 50 is fixedly fitted in a stepped annular portion (annular groove) 3*h* formed in the inner circumferential surface of the cover member 3.

The housing 5 includes a housing main body (tubular portion) 5*a* and a sealing plate 11. The housing main body 5*a* is formed in a tubular shape having its bottom by press molding. The housing main body 5*a* is formed of iron-based metal material. The sealing plate 11 is formed of non-magnetic synthetic resin, and seals a front-end opening of the housing main body 5*a*.

The housing main body 5*a* includes a bottom portion 5*b* at a rear end portion of the housing main body 5*a*. The bottom portion 5*b* is formed in a circular-disk shape. Moreover, the bottom portion 5*b* is formed with a shaft-portion insertion hole 5*c* having a large diameter, at a substantially center of the bottom portion 5*b*. An after-mentioned eccentric shaft portion 39 is inserted through the shaft-portion insertion hole 5*c*. A hole edge of the shaft-portion insertion hole 5*c* is formed integrally with an extending portion (exiting portion) 5*d* which protrudes from the bottom portion 5*b* in the axial direction of the cam shaft 2 in a cylindrical-tube shape. Moreover, an outer circumferential portion of a front-end surface of the bottom portion 5*b* is formed integrally with the female-thread constituting portion 6.

The cam shaft 2 includes two drive cams per one cylinder of the engine. Each drive cam is provided on an outer circumference of the cam shaft 2, and functions to open an intake valve (not shown). The front end portion of the cam shaft 2 is formed integrally with a flange portion 2*a*.

As shown in FIG. 2, an outer diameter of the flange portion 2*a* is designed to be slightly larger than an outer diameter of an after-mentioned fixing end portion 9*a* of the follower member 9. An outer circumferential portion of a front end surface 2*e* of the flange portion 2*a* is in contact with an axially outer end surface of the inner race 43*b* of the large-diameter ball bearing 43, after an assembly of respective structural components. Moreover, the front end surface 2*e* of the flange portion 2*a* is fixedly connected with the follower member 9 from the axial direction by a cam bolt 10 under a state where the front end surface 2*e* of the flange portion 2*a* is in contact with the follower member 9 in the axial direction.

As shown in FIG. 5, an outer circumference of the flange portion 2*a* is formed with a stopper concave groove 2*b* into which the stopper convex portion 61*b* of the retaining plate 61 is inserted and engaged. The stopper concave groove 2*b* is formed along a circumferential direction of the flange portion 2*a*. The stopper concave groove 2*b* is formed in a circular-arc shape in cross section. The stopper concave groove 2*b* is formed in an outer circumferential surface of the flange portion 2*a* within a predetermined range given in a circumferential direction of the cam shaft 2. The cam shaft 2 rotates within this circumferential range relative to the sprocket main body 1*a* so that one of both end edges of the stopper convex portion 61*b* becomes in contact with the corresponding one of circumferentially-opposed edges 2*c* and 2*d* of the stopper concave groove 2*b*. Thereby, a relative rotational position of the cam shaft 2 to the timing sprocket 1 is restricted between a maximum advanced side and a maximum retarded side.

The stopper convex portion 61*b* is disposed axially away toward the cam shaft 2 from a point at which the outer race 43*a* of the large-diameter ball bearing 43 is pressed by the spacer for fixing the outer race 43*a* in the axial direction. Accordingly, the stopper convex portion 61*b* is not in contact with the fixing end portion 9*a* of the follower member 9. Therefore, an interference between the stopper convex portion 61*b* and the fixing end portion 9*a* can be sufficiently suppressed.

The stopper convex portion 61*b* and the stopper concave groove 2*b* constitute a stopper mechanism.

As shown in FIG. 2, the cam bolt 10 includes a head portion 10*a* and a shaft portion 10*b*. A washer portion 10*c* formed in an annular shape is provided on an end surface of the head portion 10*a* which is located on the side of the shaft portion 10*b*. An outer circumference of the shaft portion 10*b* includes a male thread portion 10*d* which is screwed into a female threaded portion of the cam shaft 2. The female threaded portion of the cam shaft 2 is formed from the end portion of the cam shaft 2 toward an inside of the cam shaft 2 in the axial direction.

The follower member 9 is integrally formed of an iron-based metal. As shown in FIG. 2, the follower member 9 includes the fixing end portion 9*a*, a cylindrical portion (circular tube portion) 9*b* and a cylindrical retainer 41. The fixing end portion 9*a* is in a circular-plate shape and is formed in a rear end side of the follower member 9. The cylindrical portion 9*b* protrudes in the axial direction from a front end of an inner circumferential portion of the fixing end portion 9*a*. The retainer 41 is formed integrally with an outer circumferential portion of the fixing end portion 9*a*, and retains a plurality of rollers 48.

A rear end surface of the fixing end portion 9*a* is in contact with the front end surface of the flange portion 2*a* of the cam shaft 2. The fixing end portion 9*a* is pressed and fixed to the flange portion 2*a* in the axial direction by an axial force of the cam bolt 10.

As shown in FIG. 2, the cylindrical portion 9*b* is formed with an insertion hole 9*d* passing through a center of the cylindrical portion 9*b* in the axial direction. The shaft portion 10*b* of the cam bolt 10 is passed through the insertion hole 9*d*. Moreover, a needle bearing 38 is provided on an outer circumferential side of the cylindrical portion 9*b*.

As shown in FIGS. 2-4, the retainer 41 is formed in a cylindrical shape (circular-tube shape) having its bottom and protruding from the bottom in the extending direction of the cylindrical portion 9*b*. The retainer 41 is bent in a substantially L-shape in cross section from a front end of the outer circumferential portion of the fixing end portion 9*a*. A tubular tip portion 41*a* of the retainer 41 extends and exits through a space portion 44 toward the bottom portion 5*b* of the housing 5. The space portion 44 is an annular concave portion formed between the female-thread constituting portion 6 and the extending portion 5*d*. Moreover, a plurality of roller-retaining holes 41*b* are formed in the tip portion 41*a* substantially at circumferentially equally-spaced intervals. Each of the plurality of roller-retaining holes 41*b* is formed in a substantially rectangular shape in cross section, and functions as a roller retaining portion which retains the roller 48 to allow a rolling movement of the roller 48. The total number of the roller-retaining holes 41*b* (or the total number of the rollers 48) is smaller by one than the total number of the internal teeth 19*a* of the internal-teeth constituting portion 19.

An inner-race fixing portion 63 is formed in a cut-out manner between the outer circumferential portion of the fixing end portion 9*a* and a bottom-side connecting portion of the retainer 41. The inner-race fixing portion 63 fixes or fastens the inner race 43*b* of the large-diameter ball bearing 43.

The inner-race fixing portion 63 is formed by cutting the follower member in a stepped manner (multilevel manner) such that the inner-race fixing portion 63 faces the outer-race fixing portion 60 in the radial direction. The inner-race fixing portion 63 includes an outer circumferential surface 63*a* and a second fixing stepped surface (multilevel-linking surface) 63*b*. The outer circumferential surface 63*a* is in an annular shape (tubular shape) extending in the axial direction of the cam shaft 2. The second fixing stepped surface 63*b* is formed integrally with the outer circumferential surface 63*a* on a side opposite to an opening of the outer circumferential surface 63*a*, and extends in the radial direction. The inner race 43*b* of the large-diameter ball bearing 43 is fitted into the outer circumferential surface 63*a* in the axial direction by means of press fitting. Thereby, an inner end surface 43*f* of the press-fitted inner race 43*b* becomes in contact with the second fixing stepped surface 63*b*, so that an axial positioning of the inner race 43*b* is done.

The phase change mechanism 4 includes the electric motor 12 and the speed-reduction mechanism 8. The electric motor 12 functions as an actuator and is disposed on a front end side of the cam shaft 2, substantially coaxially to the cam shaft 2. The speed-reduction mechanism 8 functions to reduce a rotational speed of the electric motor 12 and to transmit the reduced rotational speed to the cam shaft 2.

As shown in FIGS. 2 and 3, the electric motor 12 is a brush DC motor. The electric motor 12 is constituted by the housing 5, a motor output shaft 13, a pair of permanent magnets 14 and 15, and a stator 16. The housing 5 is a yoke which rotates integrally with the timing sprocket 1. The motor output shaft 13 functions as a medium rotating member, and is arranged inside the housing 5 to be rotatable relative to the housing 5. The pair of permanent magnets 14 and 15 are fixed to an inner circumferential surface of the housing 5. Each of the pair of permanent magnets 14 and 15 is formed in a half-round arc shape. The stator 16 is fixed to the sealing plate 11.

The motor output shaft 13 is formed in a stepped tubular shape (in a cylindrical shape having multileveled surface), and functions as an armature. The motor output shaft 13 includes a large-diameter portion 13*a*, a small-diameter portion 13*b*, and a stepped portion (multilevel-linking portion) 13*c*. The stepped portion 13*c* is formed at a substantially axially center portion of the motor output shaft 13, and is a boundary between the large-diameter portion 13*a* and the small-diameter portion 13*b*. The large-diameter portion 13*a* is located on the side of the cam shaft 2 whereas the small-diameter portion 13*b* is located on the side of the brush retaining member 28. An iron-core rotor 17 is fixed to an outer circumference of the large-diameter portion 13*a*. The eccentric shaft portion 39 is fitted and fixed into the large-diameter portion 13*a* in the axial direction by means of press fitting, so that an axial positioning of the eccentric shaft portion 39 is done by an inner surface of the stepped portion 13*c*. On the other hand, an annular member (tubular member) 20 is fitted over and fixed to an outer circumference of the small-diameter portion 13*b* by press fitting. A commutator 21 is fitted over and fixed to an outer circumferential surface of the annular member 20 by means of press fitting in the axial direction. Hence, an outer surface of the stepped portion 13*c* performs an axial positioning of the annular member 20 and the commutator 21. An outer diameter of the annular member 20 is substantially equal to an outer diameter of the large-diameter portion 13*a*. An axial length of the annular member 20 is slightly shorter than an axial length of the small-diameter portion 13*b*.

The axial positioning (i.e., location setting) for both of the eccentric shaft portion 39 and the commutator 21 is performed by the inner and outer surfaces of the stepped portion 13*c*. Accordingly, an assembling work is easy while an accuracy of the positioning is improved.

The iron-core rotor 17 is formed of magnetic material having a plurality of magnetic poles. An outer circumferential side of the iron-core rotor 17 constitutes bobbins each having a slot. (A coil wire of) An electromagnetic coil 18 is wound on the bobbin.

The commutator 21 is made of electrical conductive material and is formed in an annular shape. The commutator 21 is divided into segments. The number of the segments is equal to the number of poles of the iron-core rotor 17. Each of the segments of the commutator 21 is electrically connected to a terminal 18*c* of the coil wire of the electromagnetic coil 18. That is, a tip of the terminal 18*c* of the coil wire is sandwiched by a turn-back portion of the commutator 21 which is formed on an inner circumferential side of the electromagnetic coil 18, so that the commutator 21 is electrically connected to the electromagnetic coils 18.

The permanent magnets 14 and 15 are formed in a cylindrical shape (circular-tube shape), as a whole. The permanent magnets 14 and 15 have a plurality of magnetic poles along a circumferential direction thereof. An axial location of the permanent magnets 14 and 15 is deviated (offset) in the frontward direction from an axial location of the iron-core rotor 17.

Specifically, with respect to the axial direction, a center P of the permanent magnet 14 or 15 is located at a frontward site beyond a center P1 of the iron-core rotor 17 by a predetermined distance, as shown in FIG. 2. In other words, the stator 16 is closer to the center P of the permanent magnet 14 or 15 than to the center P1 of the iron-core rotor 17 by the predetermined distance, with respect to the axial direction.

Thereby, a front end portion 14*a*, 15*a* of the permanent magnet 14, 15 overlaps with the commutator 21 and also an after-mentioned first brush 25*a*, 25*b* of the stator 16 and so on, in the radial direction.

Figure 6:
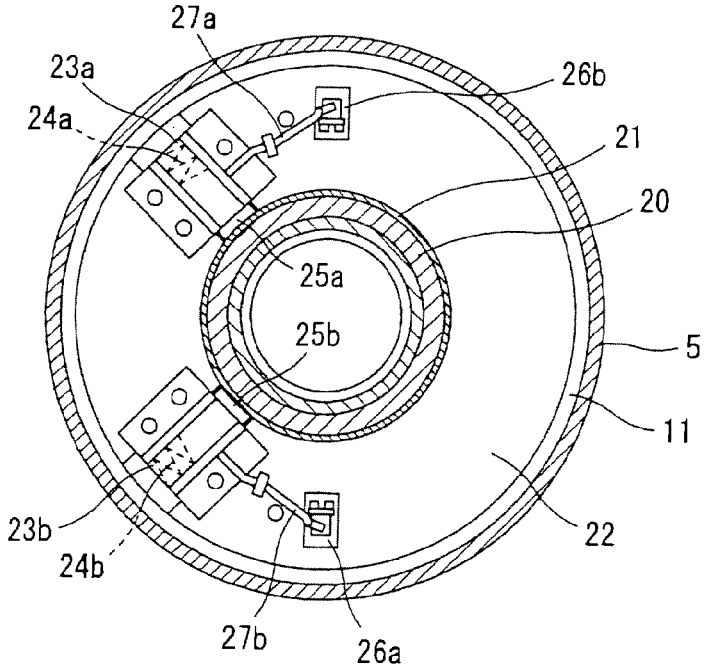
FIG. 6 A sectional view of FIG. 2, taken along a line C-C.

As shown in FIG. 6, the stator 16 mainly includes a resin plate 22, a pair of resin holders 23*a* and 23*b*, a pair of first brushes 25*a* and 25*b* each functioning as a switching brush (commutator), inner and outer slip rings 26*a* and 26*b*, and pigtail harnesses 27*a* and 27*b*. The resin plate 22 is formed in a circular plate shape, and is formed integrally with an inner circumferential portion of the sealing plate 11. The pair of resin holders 23*a* and 23*b* are provided on an inside portion (cam-shaft-side portion) of the resin plate 22. The pair of first brushes 25*a* and 25*b* are received or accommodated respectively in the pair of resin holders 23*a* and 23*b* such that the first brushes 25*a* and 25*b* are able to slide in contact with the resin holders 23*a* and 23*b* in the radial direction. Thereby, a tip surface of each of the first brushes 25*a* and 25*b* is elastically in contact with an outer circumferential surface of the commutator 21 in the radial direction by a spring force of coil spring 24*a*, 24*b*. Each of the inner and outer slip rings 26*a* and 26*b* is formed in an annular shape. The inner and outer slip rings 26*a* and 26*b* are buried in and fixed to front end surfaces of the resin holders 23*a* and 23*b* under a state where outer end surfaces (front end surfaces) of the slip rings 26*a* and 26*b* are exposed to a front-side space. The inner and outer slip rings 26*a* and 26*b* are disposed at radially inner and outer locations in a manner of radially-double layout. The pigtail harness 27*a* electrically connects the first brush 25*a* with the slip ring 26*b* whereas the pigtail harness 27*b* electrically connects the first brush 25*b* with the slip ring 26*a*. It is noted that the slip rings 26*a* and 26*b* constitute a part of a power-feeding mechanism according to the present invention. Moreover, the first brushes 25*a* and 25*b*, the commutator 21, the pigtail harnesses 27*a* and 27*b* and the like constitute an energization switching means according to the present invention.

A positioning of the sealing plate 11 is given by a concave stepped portion formed in an inner circumference of the front end portion of the housing 5. The sealing plate 11 is fixed into the concave stepped portion of the housing 5 by caulking. A shaft insertion hole 11*a* is formed in the sealing plate 11 to pass through a center portion of the sealing plate 11. One end portion of the motor output shaft 13 and so on are passing through the shaft insertion hole 11*a*.

The brush retaining member 28 is fixed to the bulging portion 3*a*. The brush retaining member 28 is integrally molded by synthetic resin material, and constitutes the power-feeding mechanism.

As shown in FIG. 2, the brush retaining member 28 is substantially formed in an L-shape as viewed in a lateral direction perpendicular to the axial direction. The brush retaining member 28 mainly includes a brush retaining portion 28*a*, a connector portion 28*b*, a pair of bracket portions 28*c* and 28*c*, and a pair of terminal strips 31 and 31. The brush retaining portion 28*a* is substantially in a cylindrical shape, and is inserted in the retaining hole 3*c*. The connector portion 28*b* is located on an upper end portion of the brush retaining portion 28*a*. The pair of bracket portions 28*c* and 28*c* are formed integrally with the brush retaining portion 28*a*, and protrude from both sides of the brush retaining portion 28*a* in both directions. Through the pair of bracket portions 28*c* and 28*c*, the brush retaining member 28 is fixed to the bulging portion 3*a*. A major part of the pair of terminal strips 31 and 31 is buried in the brush retaining member 28.

The pair of terminal strips 31 and 31 extend in the upper-lower direction, and extend parallel to each other. The pair of terminal strips 31 and 31 are formed in a crank shape. One end (lower end) 31*a* of each of the terminal strips 31 and 31 is exposed at a bottom portion of the brush retaining portion 28*a* whereas another end (upper end) 31*b* of each of the terminal strips 31 and 31 is introduced in a female fitting groove 28*d* of the connector portion 28*b* and protrudes from a bottom of the female fitting groove 28*d*. Moreover, the another ends 31*a* and 31*b* of the terminal strips 31 and 31 are electrically connected through a male connector (not shown) to a battery power source.

The brush retaining portion 28*a* is provided to extend in a substantially horizontal direction (i.e., in the axial direction). The brush retaining portion 28*a* is formed with through-holes each having a cylindrical-column shape, at upper and lower portions of an inside of the brush retaining portion 28*a*. Sliding members 29*a* and 29*b* each having a sleeve shape are provided respectively in the upper and lower through-holes of the brush retaining portion 28*a*, and are respectively fixed to the upper and lower through-holes of the brush retaining portion 28*a*. Second brushes 30*a* and 30*b* are received and retained respectively in the sliding members 29*a* and 29*b* to allow the second brushes 30*a* and 30*b* to slide in contact with the sliding members 29*a* and 29*b* in the axial direction. A tip surface of each of the second brushes 30*a* and 30*b* is in contact with the slip ring 26*a*, 26*b* in the axial direction.

Each of the second brushes 30*a* and 30*b* is formed in a substantially rectangular-parallelepiped shape. Each of second coil springs 32*a* and 32*b* which is a biasing member is elastically disposed between the second brush 30*a*, 30*b* and the one end 31*a* of the terminal strip 31 which is exposed to a bottom portion of the through-hole of the brush retaining portion 28*a*. The second brushes 30*a* and 30*b* are biased respectively toward the slip rings 26*b* and 26*a* by spring forces of the second coil springs 32*a* and 32*b*.

A pigtail harness 33*a* having a flexibility is disposed between a front end portion of the second brush 30*a* and one of the one ends 31*a* and 31*a* of the terminal strips 31 and 31, and is attached to the front end portion of the second brush 30*a* and the one of the one ends 31*a* and 31*a* by welding. In the same manner, a pigtail harness 33*b* having a flexibility is disposed between a front end portion of the second brush 30*b* and another of the one ends 31*a* and 31*a* of the terminal strips 31 and 31, and is attached to the front end portion of the second brush 30*b* and the another of the one ends 31*a* and 31*a* by welding. Thereby, the second brushes 30*a* and 30*b* are electrically connected to the terminal strips 31 and 31. A length of each of the pigtail harnesses 33*a* and 33*b* is designed to restrict a maximum sliding position of the second brush 30*a*, 30*b* such that the second brush 30*a*, 30*b* is prevented from dropping out from the sliding member 29*a*, 29*b* when the second brush 30*a*, 30*b* has moved and slid in an axially-outward direction at the maximum by the second coil spring 32*a*, 32*b*.

Moreover, an annular (ring-shaped) seal member 34 is fitted into and held by an annular fitting groove which is formed on an outer circumference of a base portion side of the brush retaining portion 28*a*. The annular seal member 34 becomes elastically in contact with a tip surface of the cylindrical wall 3*b* to seal an inside of the brush retaining portion 28*a* when the brush retaining portion 28*a* is inserted into the retaining hole 3*c*.

The male connector (not shown) is inserted into the female fitting groove 28*d* which is located at an upper end portion of the connector portion 28*b*. The another ends 31*b* and 31*b* which are exposed to the female fitting groove 28*d* of the connector portion 28*b* are electrically connected through the male connector to a control unit (not shown).

Each of the bracket portions 28*c* and 28*c* is formed in a substantially triangular shape and is formed with a bolt insertion hole 28*e*. Theses bolt insertion holes 28*e* and 28*e* located at both sides of the brush retaining portion 28*a* axially pass through the bracket portions 28*c* and 28*c*. A pair of bolts are respectively inserted through the bolt insertion holes 28*e* and 28*e*, and are screwed into a pair of female threaded holes (not shown) formed in the bulging portion 3*a*. Thereby, the brush retaining member 28 is fixed to the bulging portion 3*a* through the bracket portions 28*c* and 28*c*.

The motor output shaft 13 and the eccentric shaft portion 39 are rotatably supported by the small-diameter ball bearing 37 and the needle bearing 38. The small-diameter ball bearing 37 is provided on an outer circumferential surface of a head-portion-side portion of the shaft portion 10*b* of the cam bolt 10. The needle bearing 38 is provided on an outer circumferential surface of the cylindrical portion 9*b* of the follower member 9, and is located axially adjacent to the small-diameter ball bearing 37. The small-diameter ball bearing 37 and the needle bearing 38 constitute a bearing mechanism.

The needle bearing 38 includes a cylindrical retainer 38*a* and a plurality of needle rollers 38*b*. The retainer 38*a* is formed in a cylindrical shape (circular-tube shape), and is fitted in an inner circumferential surface of the eccentric shaft portion 39 by press fitting. Each needle roller 38*b* is a rolling element supported rotatably inside the retainer 38*a*. The needle rollers 38*b* roll on the outer circumferential surface of the cylindrical portion 9*b* of the follower member 9.

An inner race of the small-diameter ball bearing 37 is fixed between a front end edge of the cylindrical portion 9*b* of the follower member 9 and a washer 10*c* of the cam bolt 10 in a sandwiched state. On the other hand, an outer race of the small-diameter ball bearing 37 is axially positioned and supported between a snap ring 45 and a stepped portion (multi-level-linking portion) formed in an inner circumference of the motor output shaft 13. The snap ring 45 functions as a retaining ring.

A small-diameter oil seal 46 is provided between the outer circumferential surface of the motor output shaft 13 (eccentric shaft portion 39) and an inner circumferential surface of the extending portion 5*d* of the housing 5. The oil seal 46 prevents lubricating oil from leaking from an inside of the speed-reduction mechanism 8 into the electric motor 12. The oil seal 46 separates the electric motor 12 from the speed-reduction mechanism 8. An inner circumferential portion (radially-inner portion) of the small-diameter oil seal 46 is elastically in contact with the outer circumferential surface of the motor output shaft 13, and thereby gives friction resistance to the rotation of the motor output shaft 13.

The control unit detects a current operating state of the engine on the basis of information signals derived from various kinds of sensors and the like, such as a crank angle sensor, an air flow meter, a water temperature sensor and an accelerator opening sensor (not shown). Thereby, the control unit controls the engine. Moreover, the control unit performs a rotational control for the motor output shaft 13 by supplying electric power to the electromagnetic coils 18. Thereby, the control unit controls a relative rotational phase of the cam shaft 2 to the timing sprocket 1, through the speed-reduction mechanism 8.

As shown in FIGS. 2 and 3, the speed-reduction mechanism 8 is mainly constituted by the eccentric shaft portion 39, a medium-diameter ball bearing 47, the rollers 48, the retainer 41, and the follower member 9 formed integrally with the retainer 41. The eccentric shaft portion 39 conducts an eccentric rotational motion. The medium-diameter ball bearing 47 is provided on an outer circumference of the eccentric shaft portion 39. The rollers 48 are provided on an outer circumference of the medium-diameter ball bearing 47. The retainer 41 retains (guides) the rollers 48 along a rolling direction of the rollers 48, and permits a radial movement of each roller 48.

The eccentric shaft portion 39 is formed in a stepped cylindrical shape (stepped circular-tube shape) having a multilevel diameter. A small-diameter portion 39*a* of the eccentric shaft portion 39 which is located in a front end side of the eccentric shaft portion 39 is fixedly fitted in an inner circumferential surface of the large-diameter portion 13*a* of the motor output shaft 13 by press fitting. An outer circumferential surface of a large-diameter portion 39*b* of the eccentric shaft portion 39 which is located in a rear end side of the eccentric shaft portion 39, i.e. a cam surface of the eccentric shaft portion 39 has a center (axis) Y which is eccentric (deviated) slightly from a shaft center X of the motor output shaft 13 in the radial direction. It is noted that the medium-diameter ball bearing 47, the rollers 48 and the like constitute a planetary meshing portion.

Substantially whole of the medium-diameter ball bearing 47 overlaps with the needle bearing 38 in the radial direction, i.e., the medium-diameter ball bearing 47 is located approximately within an axial existence range of the needle bearing 38. The medium-diameter ball bearing 47 includes an inner race 47*a*, an outer race 47*b*, and a ball(s) 47*c* interposed between both the races 47*a* and 47*b*. The inner race 47*a* is fixed to the outer circumferential surface of the eccentric shaft portion 39 by press fitting. The outer race 47*b* is not fixed in the axial direction, and thereby is in an axially freely-movable state. That is, one of axial end surfaces of the outer race 47*b* which is closer to the electric motor 12 is not in contact with any member whereas another 47*d* of the axial end surfaces of the outer race 47*b* faces an inside surface of the retainer 41 to have a first clearance (minute clearance) C between the another 47*d* of the axial end surfaces of the outer race 47*b* and the inside surface of the retainer 41. Moreover, an outer circumferential surface of the outer race 47*b* is in contact with an outer circumferential surface of each of the rollers 48 so as to allow the rolling motion of each roller 48. An annular second clearance C1 is formed on the outer circumferential surface of the outer race 47*b*. By virtue of the second clearance C1, whole of the medium-diameter ball bearing 47 can move in the radial direction in response to an eccentric rotation (of the outer circumferential surface) of the eccentric shaft portion 39, i.e., can perform an eccentric movement.

Each of the rollers 48 is formed of iron-based metal. With the eccentric movement of the medium-diameter ball bearing 47, the respective rollers 48 move in the radial direction and are fitted in the internal teeth 19*a* of the internal-teeth constituting portion 19. Also, with the eccentric movement of the medium-diameter ball bearing 47, the rollers 48 are forced to do a swinging motion in the radial direction while being guided in the circumferential direction by both side edges of the roller-retaining holes 41*b* of the retainer 41.

Lubricating oil is supplied into the speed-reduction mechanism 8 by a lubricating-oil supplying means. This lubricating-oil supplying means includes an oil supply passage, an oil supply hole 51, an oil hole 52 having a small hole diameter, and three oil discharge holes (not shown) each having a large hole diameter. The oil supply passage is formed inside the bearing of the cylinder head. Lubricating oil is supplied from a main oil gallery (not shown) to the oil supply passage. The oil supply hole 51 is formed inside the cam shaft 2 to extend in the axial direction as shown in FIG. 2. The oil supply hole 51 communicates though a groove(s) with the oil supply passage. The oil hole 52 is formed inside the follower member 9 to pass through the follower member 9 in the axial direction. One end of the oil hole 52 is open to the oil supply hole 51, and another end of the oil hole 52 is open to a region near the needle bearing 38 and the medium-diameter ball bearing 47. The three oil discharge holes are formed inside the follower member 9 to pass through the follower member 9 in the same manner.

By the lubricating-oil supplying means, lubricating oil is supplied to the space portion 44 and held in the space portion 44. Thereby, the lubricating oil is sufficiently supplied to moving elements such as the medium-diameter ball bearing 47 and the rollers 48. It is noted that the small-diameter oil seal 46 inhibits the lubricating oil held in the space portion 44 from leaking to the inside of the housing 5.

A cap 53 is fixedly fitted into an inner surface of front end portion of the motor output shaft 13 by press fitting. As shown in FIG. 2, the cap 53 is formed in a substantially U-shape in cross section, and closes a space adjacent to the cam bolt 10.

Next, operations in this embodiment according to the present invention will now be explained. At first, when the crankshaft of the engine is drivingly rotated, the timing sprocket 1 is rotated through the timing chain 42. This rotative force is transmitted through the internal-teeth constituting portion 19 and the female-thread constituting portion 6 to the housing 5. Thereby, the electric motor 12 rotates in synchronization. On the other hand, the rotative force of the internal-teeth constituting portion 19 is transmitted through the rollers 48, the retainer 41 and the follower member 9 to the cam shaft 2. Thereby, the cam of the cam shaft 2 opens and closes the intake valve.

Under a predetermined engine-operating state after the start of the engine, the control unit supplies electric power to the electromagnetic coils 17 of the electric motor 12 through the terminal strips 31 and 31, the pigtail harnesses 32*a* and 32*b*, the second brushes 30*a* and 30*b* and the slip rings 26*b* and 26*a* and the like. Thereby, the rotation of the motor output shaft 13 is driven. This rotative force of the motor output shaft 13 is transmitted through the speed-reduction mechanism 8 to the cam shaft 2 so that a reduced rotation is transmitted to the cam shaft 2.

That is, the eccentric shaft portion 39 eccentrically rotates in accordance with the rotation of the motor output shaft 13. Thereby, each roller 48 rides over (is disengaged from) one internal tooth 19*a* of the internal-teeth constituting portion 19 and moves to the other adjacent internal tooth 19*a* with its rolling motion while being radially guided by the roller-retaining holes 41*b* of the retainer 41, every one rotation of the motor output shaft 13. By repeating this motion sequentially, each roller 48 rolls in the circumferential direction under a contact state. By this contact rolling motion of each roller 48, the rotative force is transmitted to the follower member 9 while the rotational speed of the motor output shaft 13 is reduced. A speed reduction rate which is obtained at this time can be set at any value by adjusting the number of rollers 48 and the like.

Accordingly, the cam shaft 2 rotates in the forward or reverse direction relative to the timing sprocket 1 so that the relative rotational phase between the cam shaft 2 and the timing sprocket 1 is changed. Thereby, opening and closing timings of the intake valve are controllably changed to its advance or retard side.

A maximum positional restriction (angular position limitation) for the forward/reverse relative rotation of cam shaft 2 to the timing sprocket 1 is performed when one of respective lateral surfaces (circumferentially-opposed surfaces) of the stopper convex portion 61*b* becomes in contact with the corresponding one of the circumferentially-opposed surfaces 2*c* and 2*d* of the stopper concave groove 2*b*.

Specifically, when the follower member 9 rotates (at a higher speed) in the same rotational direction as that of the timing sprocket 1 with the eccentric rotational motion of the eccentric shaft portion 39, one lateral surface of the stopper convex portion 61*b* becomes in contact with the circumferentially-opposed surface 1*c* of the stopper concave groove 2*b* so that a further relative rotation of the follower member 9 in the same direction is prohibited. Thereby, the relative rotational phase of the cam shaft 2 to the timing sprocket 1 is changed to the advance side at maximum.

On the other hand, when the follower member 9 rotates in a relatively opposite rotational direction to that of the timing sprocket 1 (i.e., at a lower speed than the timing sprocket 1), another lateral surface of the stopper convex portion 61*b* becomes in contact with the circumferentially-opposed surface 2*d* of the stopper concave groove 2*b* so that a further rotation of the follower member 9 in the relatively-opposite direction is prohibited. Thereby, the relative rotational phase of the cam shaft 2 to the timing sprocket 1 is changed to the retard side at maximum.

As a result, the opening and closing timings of the intake valve can be changed to the advance side or the retard side up to its maximum. Therefore, a fuel economy and an output performance of the engine are improved.

In this embodiment, as mentioned above, the laser hardening is not applied to entire timing sprocket 1, but is individually applied to the surface of the gear portion 1*b* and also the tooth tops 19*b* and the both tooth surfaces 19*c* of the internal teeth 19*a* so as to secure a high degree of hardness. Thereby, particularly as shown in FIGS. 1 and 4, a thermal deformation in each thin-wall portion 19*e* located between the internal teeth 19*a* and the bolt insertion hole 1*c* of the internal-teeth constituting portion 19 can be suppressed. Hence, whole of the internal teeth 19*a* has a uniform and accurate teeth profile (i.e., a uniform and accurate shape of each tooth).

That is, in the earlier technology, a heat treatment such as a carburizing-and-quenching is applied to entire timing sprocket 1 such that a high surface hardness of the entire timing sprocket 1 is secured, in order to ensure the uniform and accurate teeth profile of whole the internal teeth 19*a* and in order to ensure an abrasion resistance of the internal teeth 19*a* meshed with the rollers 48 and an abrasion resistance of the gear portion 1*b* on which the timing chain is wound. However, the thin-wall portion 19*e* located between the internal teeth 19*a* and the bolt insertion hole 1*c* is partly deformed by a thermal influence due to high heat at the time of the heat treatment. As a result, the uniform and accurate teeth profile over an entire circumference of the internal teeth 19*a* cannot be attained.

Because the accurate teeth profile of the internal teeth 19*a* is not obtained due to the partial deformation of each thin-wall portion 19*e*, a play (looseness) between the rollers 48 and the internal teeth 19*a* is not inhibited from being enlarged and also not inhibited from having an initial variability, in the case of earlier technology. As a result, relatively large noise occurs when the variable valve device is in operation.

Therefore, in the case of earlier technology, each bolt insertion hole 1*c* needs to exist at a location shifted in a radially outer direction of the internal-teeth constituting portion 19 such that the thin-wall portion is made to be thicker, in order to reduce the teeth-shape deformation of the internal teeth 19*a* which is caused due to the thermal deformation of the thin-wall portion 19*e*. As a result, whole the variable valve device inevitably grows in size.

In the embodiment according to the present invention, the thermal influence to the thin-wall portion 19*e* located between the internal teeth 19*a* and the bolt insertion hole 1*c* can be sufficiently suppressed by individually applying the laser-hardening heat treatment to the internal teeth 19*a* and the gear portion 1*b*. In more detail, the laser-hardening heat treatment is not applied to whole of the internal teeth 19*a*. That is, the laser-hardening heat treatment is applied to the tooth top 19*b* and the both tooth surfaces 19*c* and 19*c* which receive great load when the rollers 48 ride over the internal teeth 19*a*, and is not applied to the tooth bottom surface 19*d*. Hence, the thermal influence to each thin-wall portion 19*e* can be further avoided.

As a result, the abrasion of each internal tooth 19*a* can be suppressed, and also, the uniform and accurate teeth profile can be ensured over whole of the internal teeth 19*a* without shifting the forming location of each bolt insertion hole 1*c* in the radially outer direction.

Moreover, the thin-wall portion 19*e* has a sufficient toughness because the effective hardening depth is given within the range substantially from 0.3 mm to 1.5 mm. Accordingly, even if the thin-wall portion 19*e* is deformed a little in a diameter-shrinking direction at the time of heat treatment, crack or breakage of the thin-wall portion 19*e* is not generated. Moreover, when load acts from the rollers 48, the thin-wall portion 19*e* including the tooth bottom surface 19*d* is elastically deformed to absorb the shrunk diameter. Hence, the rollers 48 can smoothly go over the tooth tops 19*b* of the internal teeth 19*a*.

Therefore, when alternating torque generated in the cam shaft 2 is transmitted through the retainer 41 to the rollers 48 so that the rollers 48 go over (ride over) the internal teeth 19*a*, the generation of abrasion and the worsening of teeth-shape accuracy due to load can be suppressed. Hence, noise which is generated by the play (looseness) between the internal teeth 19*a* and the rollers 48 can be sufficiently suppressed.

Moreover, in the embodiment according to the present invention, one winding wire 18*a* of the electromagnetic coil 18 is placed close to the commutator 21 with respect to the axial direction whereas another winding wire 18*b* of the electromagnetic coil 18 is placed in a recess 5*e* of the bottom portion 5*b* of the housing 5 in a state where the another winding wire 18*b* is accommodated in the recess 5*e* in the axial direction. Hence, an axial length of the variable valve device can be shortened. Accordingly, a mountability of the variable valve device to the internal combustion engine is improved.

Moreover, in the embodiment according to the present invention, the axial center P of the permanent magnet 14, 15 is deviated (offset) from the axial center P1 of the iron-core rotor 17 in the frontward direction, as mentioned above. Hence, the iron-core rotor 17 is sucked in the frontward direction (i.e., left direction of FIG. 2) by magnetic force generated between the permanent magnet 14, 15 and the iron-core rotor 17, so that the iron-core rotor 17, the motor output shaft 13 and the eccentric shaft portion 39 are constantly attracted in an arrow direction. That is, because each of the permanent magnet 14, 15 and the iron-core rotor 17 has its maximum magnetic force at the axial center P, P1 thereof, an attracting force of the permanent magnet 14, 15 acts on the iron-core rotor 17 so as to attract the iron-core rotor 17 toward the axial center P of the permanent magnet 14, 15. Thereby, the iron-core rotor 17, the motor output shaft 13 and the eccentric shaft portion 39 are strongly attracted in the arrow direction.

Concurrently, the small-diameter ball bearing 37, the needle bearing 38 and the medium-diameter ball bearing 47 are also attracted in the arrow direction.

Hence, the alternating torque which is caused in the cam shaft 2 due to spring force of a valve spring and the like can be inhibited from producing axial micro-vibrations of the ball bearings 37 and 47 and the needle bearing 38 which are accompanied by noises.

Moreover, because the axial location of the permanent magnet 14, 15 is deviated as mentioned above, the front end portion 14*a*, 15*a* of the permanent magnet 14, 15 can overlap with the commutator 21 and also the first brush 25*a*, 25*b*. Hence, the axial length of the variable valve device can be further shortened The present invention is not limited to the structures explained in the above embodiments. For example, as the surface treatment of the gear portion 1*b* and the internal teeth 19*a*, an induction hardening or the like may be employed instead of the laser hardening.

Moreover, instead of the eccentric shaft portion, a thickness of the inner race 47*a* of the medium-diameter ball bearing 47 may be varied along the circumferential direction such that the inner race 47*a* is eccentric (deviated) with respect to an axis of the medium-diameter ball bearing 47. In this case, the eccentric shaft portion 39 is replaced with an extension of the motor output shaft 13 or a concentric cylindrical portion (concentric cylindrical-tube portion).

EXPLANATION OF REFERENCE SIGNS

1 Timing sprocket (Drive rotating member)
1*a* Sprocket main body
1*b* Gear portion
1*c* Bolt insertion hole (Hole)
2 Cam shaft
3 Cover member
4 Phase change mechanism
5 Housing

7 Bolt
8 Speed-reduction mechanism
9 Follower member (Driven rotating member)
12 Electric motor
13 Motor output shaft
14, 15 Permanent magnet
19 Internal-teeth constituting portion (Inner-circumferential meshing portion)
19*a* Internal teeth
19*b* Tooth top
19*c* Tooth surface
19*d* Tooth bottom surface
19*e* Thin-wall portion
39 Eccentric shaft portion
48 Roller

The invention claimed is:

1. A variable valve device for an internal combustion engine, comprising:

a drive rotating member configured to receive a rotational force from a crankshaft, the drive rotating member including an annular internal-teeth constituting portion having an inner circumferential portion formed with internal teeth;

an electric motor including a motor output shaft configured to rotate relative to the drive rotating member on request;

an eccentric shaft portion provided on the motor output shaft and formed in a cylindrical shape such that an outer circumferential surface of the eccentric shaft portion is eccentric relative to a rotational center of the eccentric shaft portion;

a plurality of rollers provided between the internal teeth and the eccentric shaft portion and having total number smaller than total number of the internal teeth; and a driven rotating member configured to rotate integrally with a cam shaft, permit the rollers to move in a radial direction of the driven rotating member according to the eccentric shaft portion, and restrict a movement of the rollers in a circumferential direction of the driven rotating member, wherein a hardness of a tooth bottom surface of the internal teeth of the internal-teeth constituting portion is lower than a hardness of a tooth top and a tooth surface of the internal teeth.

2. The variable valve device according to claim 1, wherein the internal-teeth constituting portion includes a plurality of holes formed along the circumferential direction, and each of the plurality of holes extends in an axial direction of the drive rotating member.

3. The variable valve device according to claim 2, wherein the plurality of holes are formed at even intervals in the circumferential direction of the internal-teeth constituting portion.

4. The variable valve device according to claim 2, wherein the plurality of holes pass through the drive rotating member in the axial direction.

5. The variable valve device according to claim 4, wherein the electric motor includes a stator fixed to the drive rotating member, and a rotor rotatable relative to the stator, the electric motor is configured to receive electric current from a non-rotating member through a brush and a slip ring, and bolts are inserted into the plurality of holes such that the stator is fixed to the drive rotating member.

6. The variable valve device according to claim 5, wherein a coil is wound on the rotor of the electric motor, a permanent magnet is attached to the stator, and a commutator provided on a tubular shaft of the electric motor is configured to switch electric current for energizing the coil to form magnetic flux.

7. The variable valve device according to claim 2, wherein a surrounding portion of the plurality of holes has a hardness lower than the hardness of the tooth top and the tooth surface of the internal teeth.

8. The variable valve device according to claim 1, wherein the internal-teeth constituting portion is molded by sintered metal, and a surface treatment for hardening is applied to only a range from the tooth top to the tooth surface in the internal-teeth constituting portion.

9. The variable valve device according to claim 8, wherein one of an induction hardening and a laser hardening is applied for hardening only the range from the tooth top to the tooth surface in the internal-teeth constituting portion.

10. The variable valve device according to claim 1, wherein the eccentric shaft portion is constituted by an eccentric portion whose outer circumferential surface is eccentric relative to the rotational center of the eccentric shaft portion, an inner race fixed to the eccentric portion, and an outer race rotatable relative to the inner race through a plurality of rolling elements.

11. The variable valve device according to claim 10, wherein the eccentric portion is integrally formed with the motor output shaft.

12. The variable valve device according to claim 1, wherein a radially-outer side of the internal teeth has a hardness lower than a hardness of entire surface of the internal teeth.

13. A variable valve device for an internal combustion engine, comprising:

a drive rotating member configured to receive a rotational force from a crankshaft, the drive rotating member including an annular internal-teeth constituting portion having an inner circumferential portion formed with internal teeth;

an electric motor including a motor output shaft configured to rotate relative to the drive rotating member on request;

an eccentric shaft portion provided on the motor output shaft and formed in a cylindrical shape such that an outer circumferential surface of the eccentric shaft portion is eccentric relative to a rotational center of the eccentric shaft portion;

a plurality of rollers provided between the internal teeth and the eccentric shaft portion and having total number smaller than total number of the internal teeth; and a driven rotating member configured to rotate integrally with a cam shaft, permit the rollers to move in a radial direction of the driven rotating member according to the eccentric shaft portion, and restrict a movement of the rollers in a circumferential direction of the driven rotating member, wherein a tooth top and a tooth surface of the internal teeth of the drive rotating member are hardened up to a predetermined hardness by means of hardening treatment whereas a radially-outer portion from a tooth bottom surface of the internal teeth has a flexibility.

14. The variable valve device according to claim 12, wherein an effective hardening depth of the hardening treatment is substantially within a range from 0.3 mm to 1.5 mm.

15. The variable valve device according to claim 12, wherein the hardening treatment is one of an induction hardening and a laser hardening.

16. A variable valve device for an internal combustion engine, the variable valve device being configured to vary an operating characteristic of an engine valve by rotating a control shaft, the variable valve device comprising:

an annular internal-teeth constituting portion having an inner circumferential portion formed with internal teeth;

an electric motor including a motor output shaft configured to rotate relative to the internal-teeth constituting portion on request;

an eccentric shaft portion provided on the motor output shaft and formed in a cylindrical shape such that an outer circumferential surface of the eccentric shaft portion is eccentric relative to a rotational center of the eccentric shaft portion;

a plurality of rollers provided between the internal teeth and the eccentric shaft portion and having total number smaller than total number of the internal teeth; and an output member configured to transmit rotational force to the control shaft, permit the rollers to move in a radial direction of the output member according to the eccentric shaft portion, and restrict a movement of the rollers in a circumferential direction of the output member, wherein a hardness of a tooth bottom surface of the internal teeth of the internal-teeth constituting portion is lower than a hardness of a tooth top and a tooth surface of the internal teeth.

* * * * *